US006765346B2

(12) United States Patent
Lee et al.

(10) Patent No.: US 6,765,346 B2
(45) Date of Patent: Jul. 20, 2004

(54) FIELD EMISSION DISPLAY HAVING FIELD EMITTERS IN A ZIGZAG PATTERN

(75) Inventors: Byong-Gon Lee, Suwon (KR); Sung-Ho Jo, Seongnam (KR)

(73) Assignee: Samsung SDI Co., Ltd., Suwon-si (KR)

( * ) Notice: Subject to any disclaimer, the term of this patent is extended or adjusted under 35 U.S.C. 154(b) by 50 days.

(21) Appl. No.: 10/245,568

(22) Filed: Sep. 18, 2002

(65) Prior Publication Data

US 2003/0184214 A1 Oct. 2, 2003

(30) Foreign Application Priority Data

Mar. 27, 2002 (KR) ..... 2002-0016804

(51) Int. Cl.[7] ..... H01J 1/304

(52) U.S. Cl. ..... 313/497; 313/496

(58) Field of Search ..... 313/495, 496, 313/497, 309, 310, 311, 336, 351; 315/169.1; 438/20

(56) References Cited

U.S. PATENT DOCUMENTS 6,486,599 B2 * 11/2002 Wang et al. ..... 313/495
6,617,798 B2 * 9/2003 Lee et al. ..... 315/169.3
2003/0230968 A1 * 12/2003 Lee et al. ..... 313/495

* cited by examiner

*Primary Examiner*—Nimeshkumar D. Patel
*Assistant Examiner*—Karabi Guharay
(74) *Attorney, Agent, or Firm*—Staas & Halsey LLP

(57) ABSTRACT

A field emission display includes a front substrate and a rear substrate provided opposing one another with a predetermined gap therebetween; gate electrodes formed in a line pattern in a first direction and cathode electrodes formed in a line pattern in a second direction, which is perpendicular to the first direction, on a surface of the rear substrate opposing the front substrate; an insulating layer formed between the gate electrodes and the cathode electrodes; and a plurality of field emitters formed on the cathode electrodes at areas corresponding to each pixel region where the gate electrodes intersect the cathode electrodes. Any one of the field emitters adjacent in one of the first and second directions to another field emitter is at a predetermined distance from the another field emitter in the other of the first and second directions.

52 Claims, 12 Drawing Sheets

FIELD EMISSION DISPLAY HAVING FIELD EMITTERS IN A ZIGZAG PATTERN

CROSS REFERENCE TO RELATED APPLICATIONS

This application claims the benefit of Korean Application No. 2002-16804 filed Mar. 27, 2002, in the Korean Intellectual Property Office, the disclosure of which is incorporated herein by reference.

BACKGROUND OF THE INVENTION

1. Field of the Invention

The present invention relates to a field emission display, and more particularly, to a field emission display that includes field emitters made of a carbon-based material having a low work function.

2. Description of the Related Art

A field emission display (FED) is a flat display device that realizes a display of images by using a cold cathode as a source for emitting electrons. Recently, much research has been performed on formation of field emitters, in which a low work function carbon-based material that emits electrons at low voltages of approximately 10 to 15 volts is used to perform a thick layer process such as screen printing.

Where the FED employs a triode structure including a cathode, an anode, and a gate electrode, cathode electrodes and field emitters are formed on a rear substrate, and gate electrodes are formed on the cathode electrodes and emitters with an insulating layer interposed therebetween. Further, an anode electrode and phosphor layers are provided on an inner surface of a front substrate.

However, in the above triode structure, the formation of field emitters through the thick layer process is technically very difficult to perform. That is, to form the field emitters, holes are formed in the gate electrodes and the insulating layer to expose the cathode electrodes, and where performing screen printing of carbon-based material on a surface of the cathode electrodes, which are exposed through the holes, the carbon-based material may be formed extending from the cathode electrodes to the gate electrodes to thereby cause a short between the two electrodes.

FIGS. 17 and 18 show a structure in which gate electrodes 7 are arranged under cathode electrodes 3 and emitters 5 with an insulating layer 1 interposed between the gate electrodes 7 and the pairs of the cathode electrodes 3 and the field emitters 5.

In the FED shown in FIGS. 17 and 18, electric fields are formed in peripheries of the field emitters 5 by a voltage difference between the gate electrodes 7 and the cathode electrodes 3 such that electrons (indicated by the arrows in FIG. 18) are emitted from the field emitters 5. The emitted electrons are accelerated toward a front substrate 11 as a result of a high voltage of approximately 1 to 5 Kv applied to an anode electrode 9 formed on the front substrate 11. The electrons excite phosphor layers 13 formed on the front substrate 11 to thereby realize the display of predetermined images.

With such an FED, the manufacture of the field emitters 5 is easy, and a short does not occur between the gate electrodes 7 and the cathode electrodes 3. However, with the use of this structure, since there is a limited ability to focus electrons emitted from the field emitters 5, the electrons that are emitted from the emitters 5 disperse toward the front substrate 11 while moving within the display such that the emitted electrons land on unintended phosphor layers 13, that is, adjacent phosphor layers 13 of different colors. The unintended electron landings result in a mixture of colors, reducing color purity.

Examining traces of electron beams formed by the emitted electrons in more detail with reference to FIG. 18, as the distance between the field emitters 5 and the phosphor layers 13 increases, the degree of focusing of the electron beams deteriorates. That is, electron beams (2) and (3) are less focused than electron beam (1) and more dispersed in the direction of an axis Y shown in FIG. 18. Further, electron beams (2) and (3), are also dispersed in the direction of axis X as shown in FIG. 17, thereby resulting in the formation roughly of a triangle by the electrons landing on the front substrate 11.

FIG. 19 is an optical microphotograph showing an illumination pattern of actual phosphor layers by the emission of electron beams in a conventional FED. The microphotograph shows that the electron beams landing on the front substrate illuminate the phosphor layers in roughly triangular patterns. Therefore, with the dispersion of the electron beams in both X and Y axis directions in the conventional FED, adjacent phosphor layers of different colors are also illuminated (together with the intended phosphor layer) such that color purity is diminished.

SUMMARY OF THE INVENTION

An object of the present invention is to improve color purity of the display device by providing a field emission display in which electrons emitted from field emitters accurately land on phosphor layers of intended pixels rather than on phosphor layers of unintended pixels.

Additional objects and advantages of the invention will be set forth in part in the description which follows, and, in part, will be obvious from the description, or may be learned by practice of the invention.

In one embodiment, the present invention provides a field emission display comprising a front substrate and a rear substrate provided opposing one another with a predetermined gap therebetween; a plurality of gate electrodes formed in a line pattern in a first direction and a plurality of cathode electrodes formed in a line pattern in a second direction, which is perpendicular to the first direction, on a surface of the rear substrate opposing the front substrate; a plurality of field emitters formed on the cathode electrodes at areas corresponding to each pixel region where the gate electrodes intersect the cathode electrodes; an anode electrode formed over an entire surface of the front surface that opposes the rear substrate; and phosphor layers formed on the anode electrode, wherein any one of the field emitters adjacent in one of the first and second directions to another field emitter is at a predetermined distance from the another field emitter in the other of the first and second directions.

The field emitters may include first emitters and second emitters, which are alternately arranged in the direction the cathode electrodes are arranged, the first emitters having a predetermined distance in a direction perpendicular to the direction the cathode electrodes are arranged from the adjacent second emitters to thereby result in a zigzag pattern of the first and second field emitters.

The cathode electrodes may each include first and second sub-electrodes, which are arranged in a line pattern at a predetermined distance, and corresponding connecting electrodes that electrically connect the first and second sub-electrodes. Also, the first emitters may be arranged on long edges of the first sub-electrodes, which are opposite the second sub-electrodes, and the second emitters may be arranged long edges of the second sub-electrodes.

Alternatively, the field emitters include first emitters and second emitters, which are alternately arranged in the direction the gate electrodes are arranged, the first emitters having a predetermined distance in a direction perpendicular to the direction the gate electrodes are arranged from the adjacent second emitters to thereby result in a zigzag pattern of the first and second emitters.

To realize this structure, holes are formed in the cathode electrodes to expose the insulating layer at areas corresponding to each pixel region, and the holes include first and second sides that are parallel to the gate electrodes. Also, the first emitters are formed on the cathode electrodes along the first sides of the holes and the second emitters are formed on the cathode electrodes along the second sides of the holes.

BRIEF DESCRIPTION OF THE DRAWINGS

The above objects and advantages of the present invention will become more apparent by describing in detail a embodiment thereof with reference to the attached drawings in which.

DETAILED DESCRIPTION OF THE EMBODIMENTS

Figure 1:
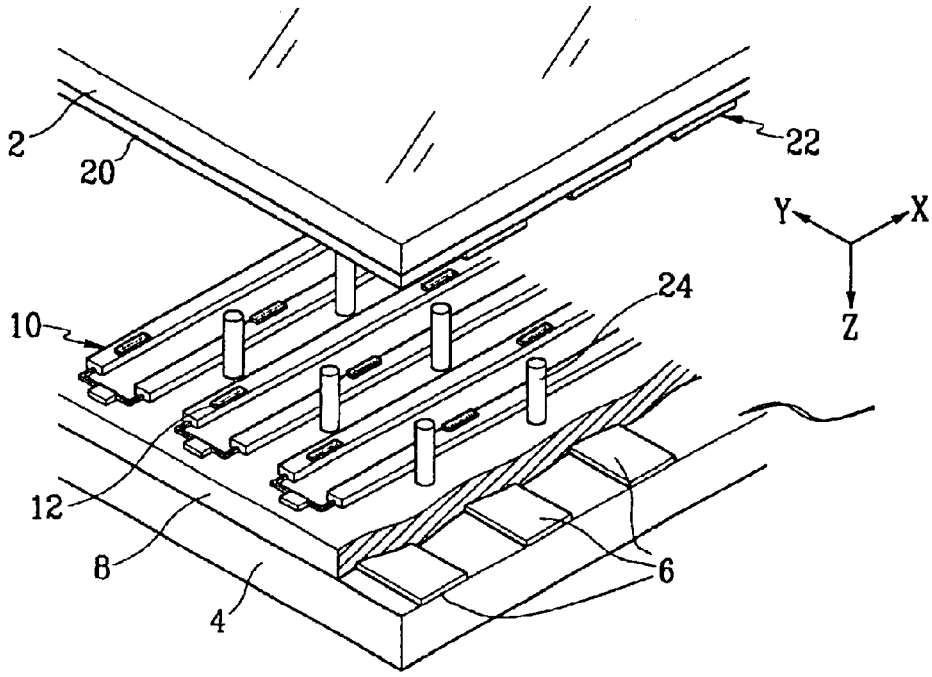
FIG. 1 is an exploded perspective view of a field emission display according to a first embodiment of the present invention.
Figure 2:
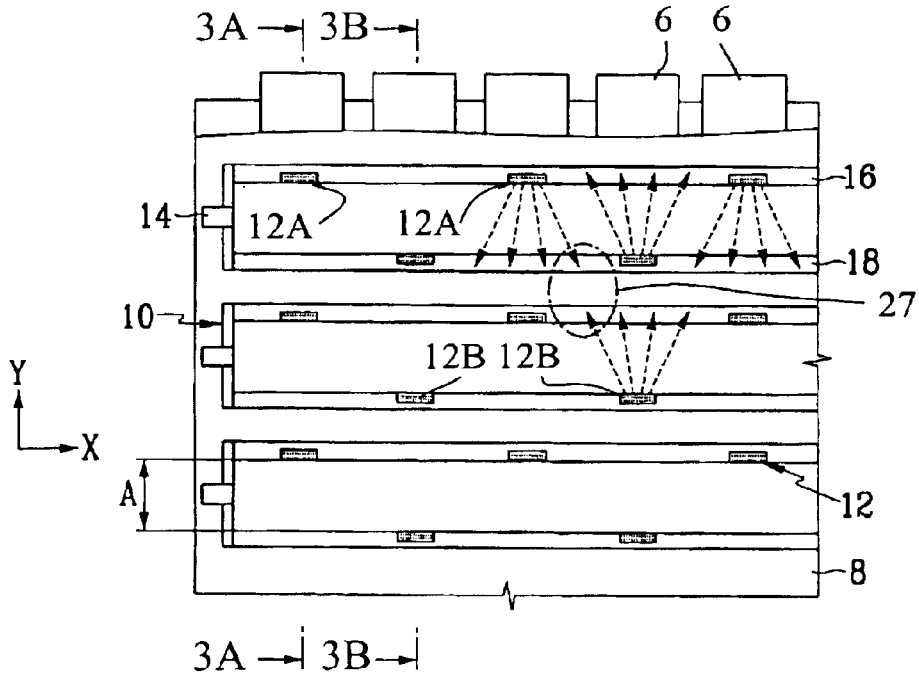
FIG. 2 is a partial plan view of a rear substrate of the field emission display shown in FIG. 1.
Figure 3A:
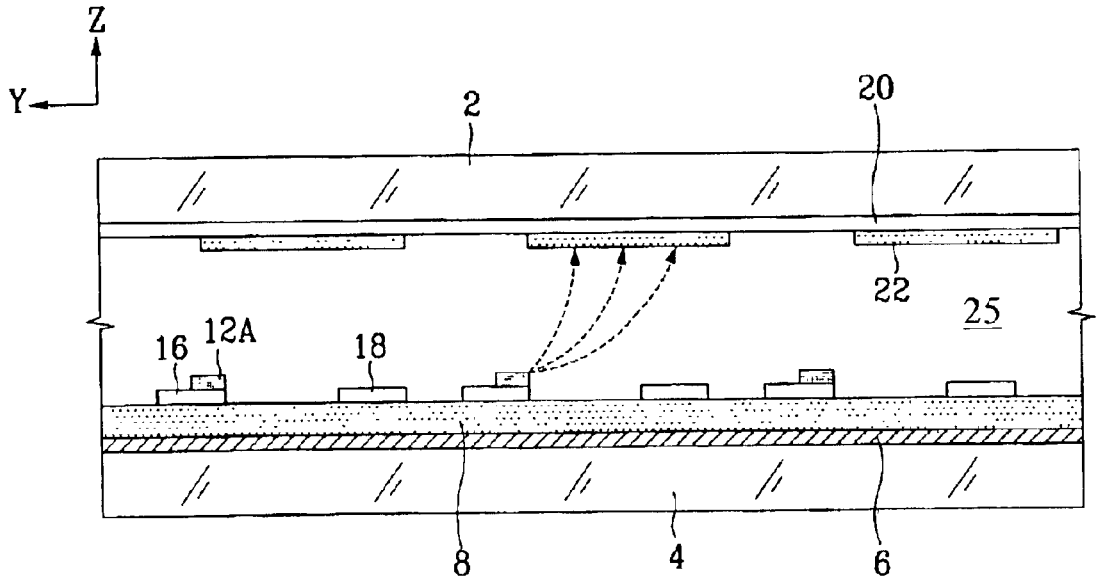
FIG. 3A is a sectional view of the rear substrate shown in FIG. 2 taken along line 3A—3A of FIG. 2 and shown positioned opposite a corresponding section of the front substrate shown in FIG. 1.
Figure 3B:
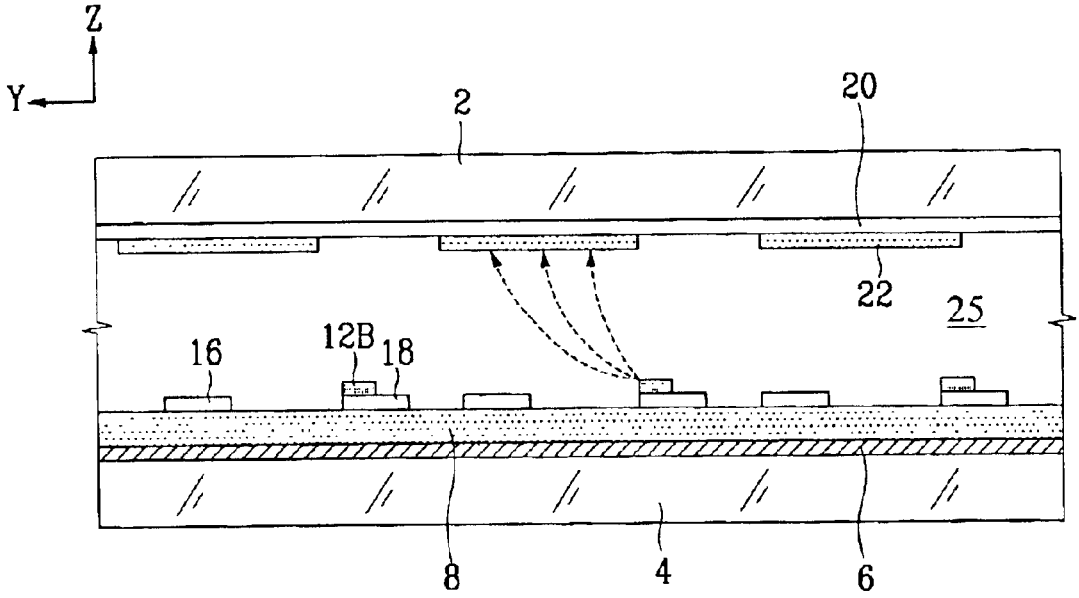
FIG. 3B is a sectional view of the rear substrate shown in FIG. 2 taken along line 3B—3B of FIG. 2 and shown positioned opposite a corresponding section of the front substrate shown in FIG. 1.

Reference will now be made in detail to the present embodiments of the present invention, examples of which are illustrated in the accompanying drawings, wherein like reference numerals refer to like elements throughout.

Referring now to FIGS. 1, 2, 3A and 3B, the first embodiment of the field emission display (FED) comprises a front substrate 2 and a rear substrate 4 provided substantially in parallel with a predetermined gap therebetween so as to define an inner space 25. The rear substrate 4 has a structure which enables an emission of electrons by a formation of electric fields, and the front substrate 2 has a structure which enables a realization of predetermined images in response to the emitted electrons.

In more detail, a plurality of gate electrodes 6 is formed in a line pattern along a first direction (in the direction of axis Y in the drawings) on the rear substrate 4. An insulating layer 8 is formed over an entire surface of the rear substrate 4 covering the gate electrodes 6. A plurality of cathode electrodes 10 is formed in a line pattern along a second direction (in the direction of axis X in the drawings) on the insulating layer 8. As a result, the cathode electrodes 10 perpendicularly intersect the gate electrodes 6.

A field emitter 12, is formed at areas where the gate electrodes 6 intersect the cathode electrodes 10. That is, one of the field emitters 12 is formed in each pixel region along edges of the cathode electrodes 10. The field emitters 12 are made of a low work function carbon-based material such as carbon nanotubes, graphite, diamond-like carbon, and $C_{60}$ (Fullerene). A paste carbon-based material undergoes thick layer printing on the cathode electrodes 10 to form the field emitters 12.

In the first embodiment of the present invention, the field emitters 12 are not all aligned along one side of the cathode electrodes 10 but instead are formed in a dot pattern corresponding to each pixel region. In more detail, first emitters 12A are formed along one long side (direction X) of each of the cathode electrodes 10 at predetermined intervals and second emitters 12B are formed along an opposite long side of each of the cathode electrodes 10 at predetermined intervals.

Along the axis X direction, each of the second emitters 12B is positioned between a pair of the first emitters 12A formed on the same cathode electrode 10, preferably at substantially a center position. Likewise, along the axis X direction, each of the first emitters 12A is provided between a pair of the second emitters 12B on the same cathode electrode 10. Further, the first and second emitters 12A and 12B, respectively, of the same cathode electrode 10 are separated by a distance A in the direction of the Y axis. This results in an overall zigzag pattern of the emitters 12. Therefore, electron beams formed by the emission of electrons from the field emitters 12 are dispersed in substantially a triangular shape from each of the field emitters 12 as shown by the arrows in the drawings, and the electron beams emitted from the field emitters 12 independently travel along their respective paths such that their respective traces do not overlap.

The cathode electrodes 10 may be realized by a structure comprising first and second sub-electrodes 16 and 18, respectively, which are connected at one end by a connecting electrode 14 such that the first and second sub-electrodes 16 and 18 are maintained at the same voltage. The first and second sub-electrodes 16 and 18 that comprise each of the cathode electrodes 10 are arranged along the axis X direction opposing each other. The field emitters 12 are arranged in the zigzag pattern as described above on edges of the first and second sub-electrodes 16 and 18.

That is, in the first embodiment of the present invention, the first emitters 12A are arranged on the first sub-electrodes 16 and the second emitters 12B are arranged on the second sub-electrodes 18. For any one of the cathode electrodes 10, there is the distance A in the axis Y direction between the first emitters 12A formed on the first sub-electrode 16 and the second emitters 12B formed on the second sub-electrode 18. Each of the cathode electrodes 10 has this arrangement.

Figure 17:
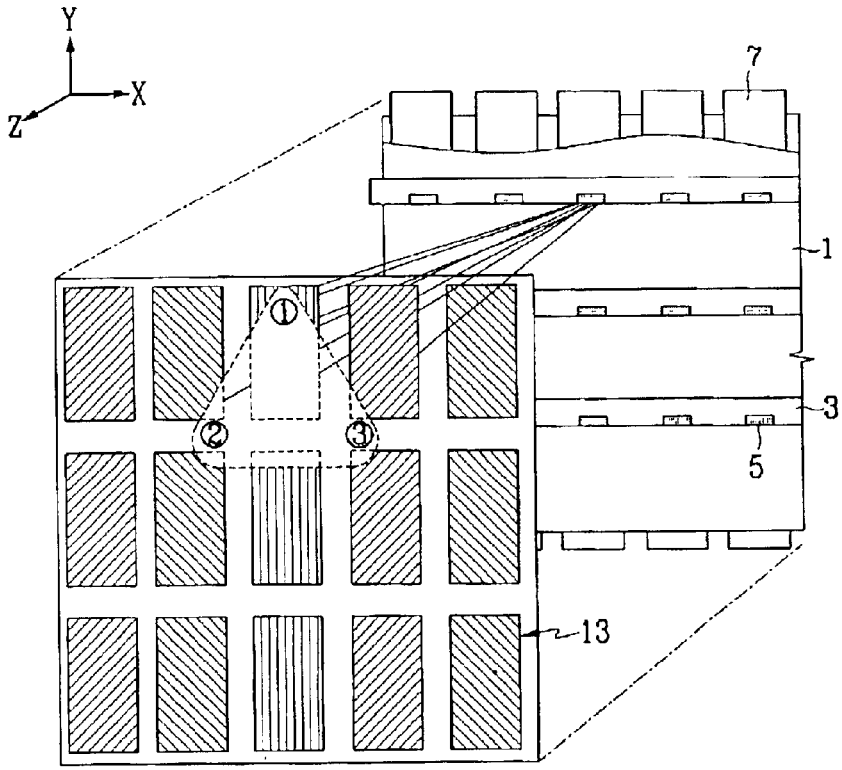
FIG. 17 (PRIOR ART)
FIG. 17 is an exploded perspective view of a conventional field emission display.
Figure 18:
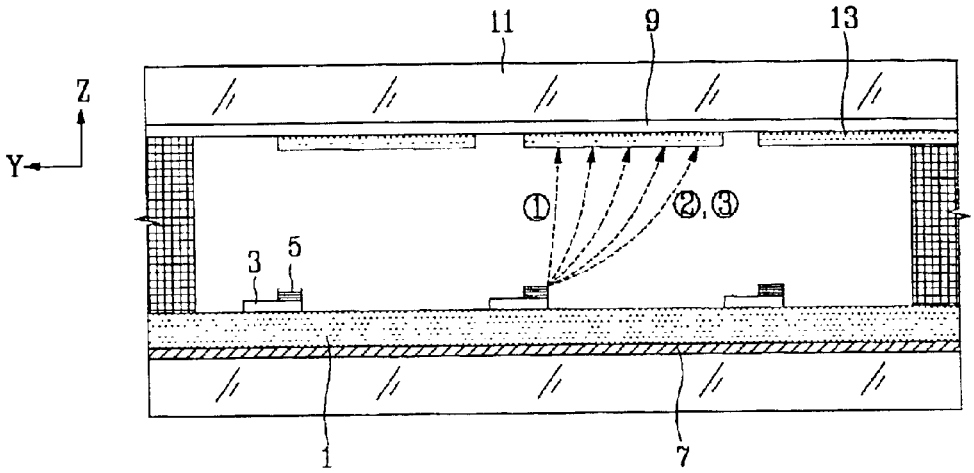
FIG. 18 (PRIOR ART)
FIG. 18 is a sectional view of a conventional field emission display.
Figure 19:
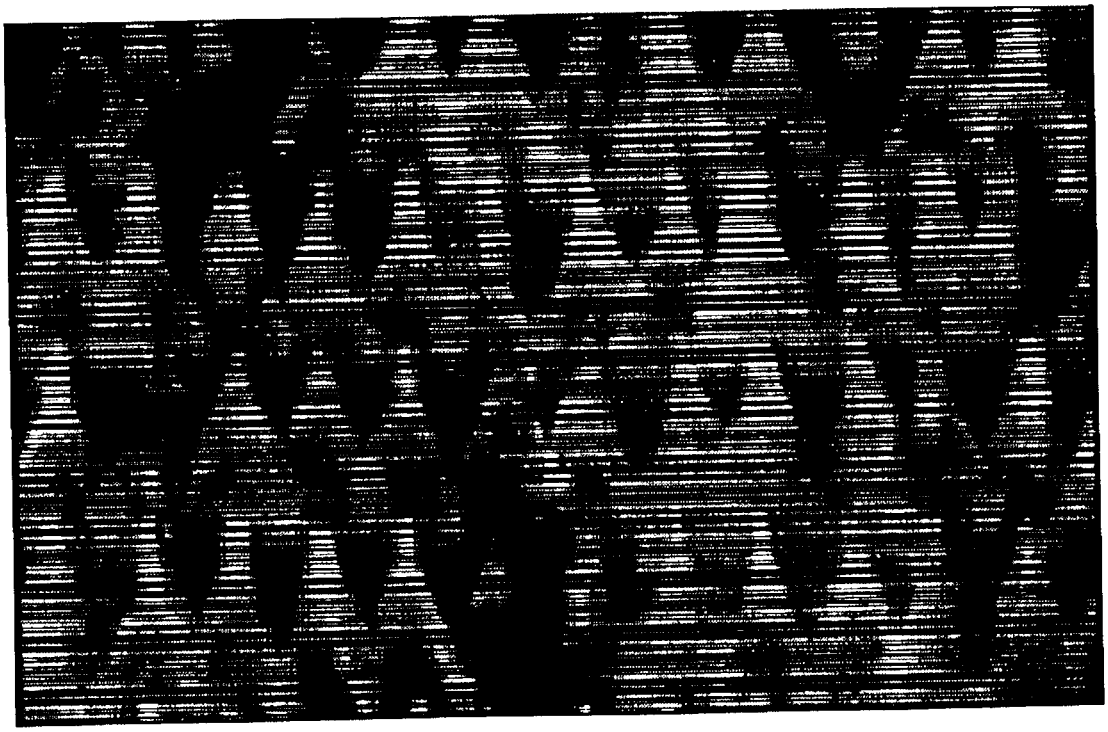
FIG. 19 (PRIOR ART)
FIG. 19 is an optical microphotograph showing an illumination pattern of actual phosphor layers by the emission of electron beams in a conventional FED.

On a surface of the front substrate 2 opposing the rear substrate 4, there are formed a transparent anode electrode 20, and a plurality of R (red), G (green), and B (blue) phosphor layers 22, which emit visible light where excited by electrons. As an example, the phosphor layers 22 may be arranged in rows in the Y axis direction with the phosphor layers 22 in one row being of the same color (see FIG. 17 of the prior art FED). A plurality of spacers 24 is provided between the front and rear substrates 2 and 4 to maintain the predetermined gap therebetween in a state where a vacuum is maintained in the inner space 25 between the first and second substrates 2 and 4.

With the above structure, if a predetermined DC or AC voltage is applied between the gate electrodes 6 and the cathode electrodes 10, and a high voltage (approximately 1 to 5 KV) needed to accelerate electrons is applied to the anode electrode 20, electric fields are formed in peripheries of the field emitters 12 by the difference in voltages applied to the gate electrodes 6 and the cathode electrodes 10 such that electrons are emitted from the field emitters 12. The emitted electrons land on the phosphor layers 22 due to the voltage applied to the anode electrode 20 to thereby illuminate the phosphor layers 22.

Since the field emitters 12 are arranged in a zigzag pattern on the first and second sub-electrodes 16 and 18 of the cathode electrodes 10 as described above, the electron beams, being dispersed in substantially a triangular shape from each of the field emitters 12, travel in the FED in a state where they are directed toward the phosphor layers 22 without overlapping. That is, the electron beams emitted from the field emitters 12 of adjacent pixels do not overlap.

Accordingly, in the first embodiment of the present invention, even without artificially altering the traces of the electron beams emitted from the field emitters 12, the electron beams do not land on unintended phosphor layers 22 of a different color. This greatly enhances color purity of the display device.

Figure 4:
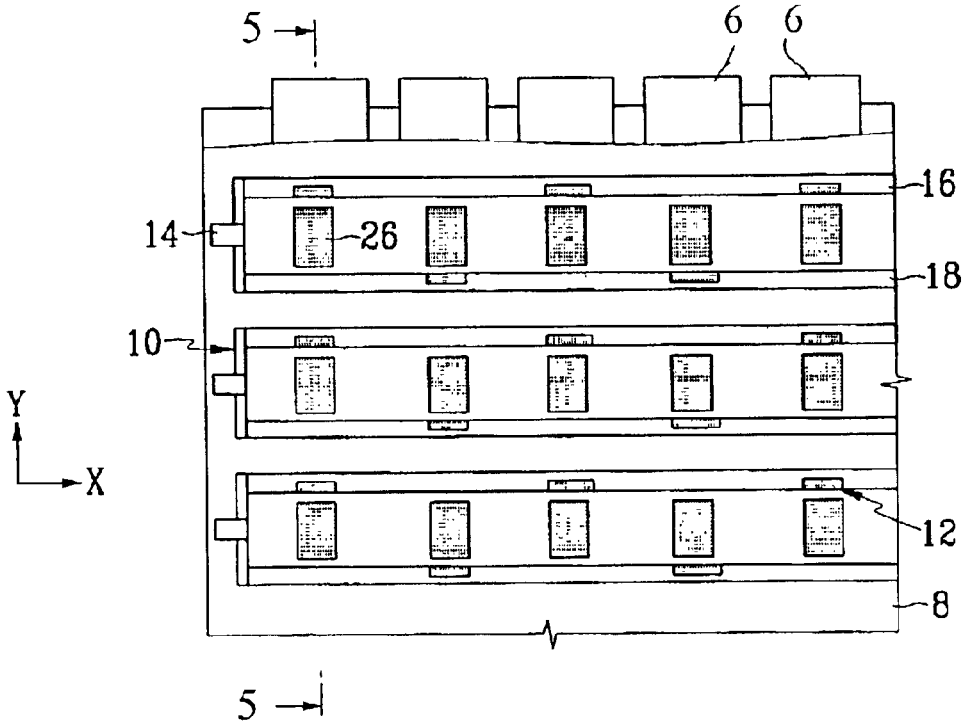
FIG. 4 is a partial plan view of a rear substrate of a field emission display according to a second embodiment of the present invention.
Figure 5:
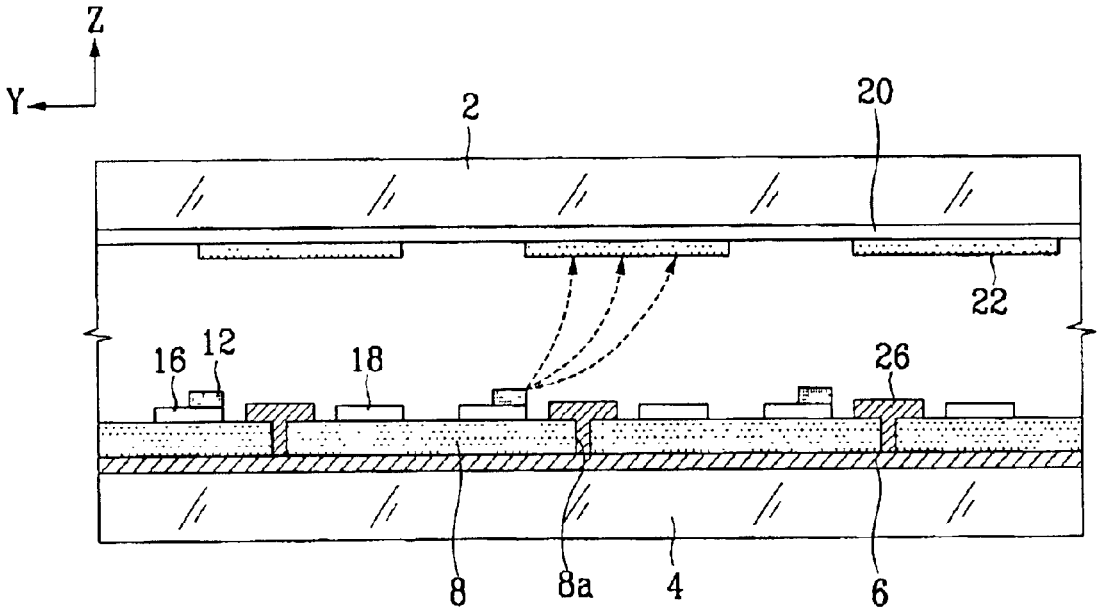
FIG. 5 is a sectional view of the rear substrate shown in FIG. 4 taken along line 5—5 of FIG. 4 and shown positioned opposite a corresponding section of the front substrate shown in FIG. 1.

Referring now to FIGS. 4 and 5 a second embodiment of the present invention further comprises a plurality of counter electrodes 26, which are formed between the first and second sub-electrodes 16 and 18 of the cathode electrodes 10. The counter electrodes 26 are electrically connected to gate electrodes 6.

In more detail, the counter electrodes 26 are formed in the pixel regions between the first and second sub-electrodes 16 and 18 of the cathode electrodes 10. As in the first embodiment, the pixel regions are formed at intersections of the gate electrodes 6 and the cathode electrodes 10. The counter electrodes 26 are partially formed on the insulating layer 8 and partially filling passage holes 8*a* formed in the insulating layer 8. With the formation of the counter electrodes 26 within the passage holes 8*a*, the counter electrodes 26 contact the gate electrodes 6 such that the counter electrodes 26 share the same voltage as the gate electrodes 6. As a result, when electric fields are formed in peripheries of the field emitters 12 by the application of a predetermined drive voltage to the gate electrodes 6, the counter electrodes 26 also form electric fields directed toward the field emitters 12 to thereby reduce a voltage required to drive the FED. The counter electrodes 26 are shown substantially rectangular but may be formed in other shapes.

Figure 6:
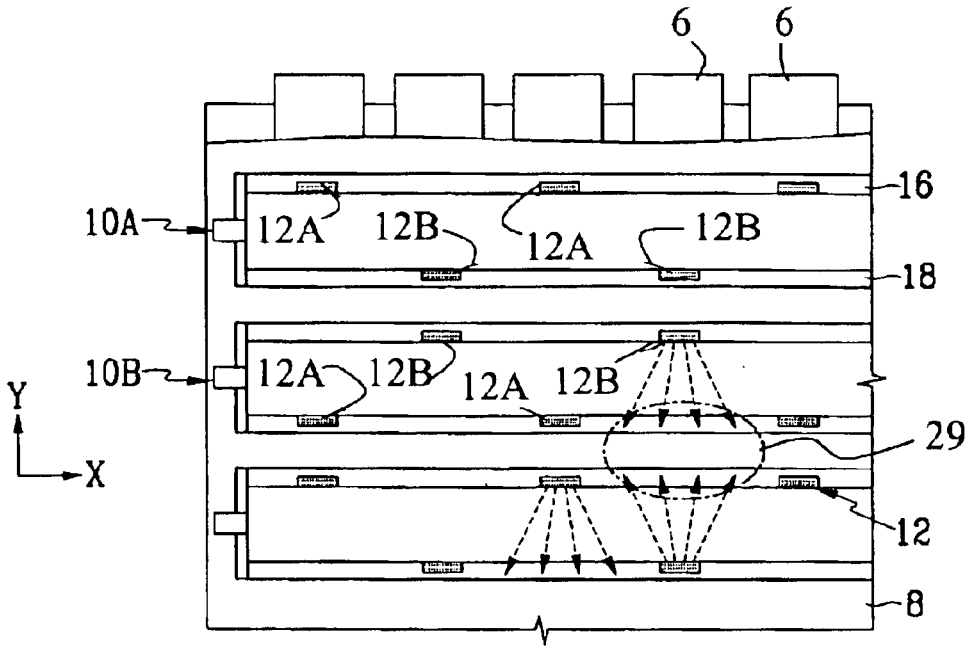
FIG. 6 is a partial plan view of a rear substrate of a field emission display according to a third embodiment of the present invention.

FIG. 6 is a partial plan view of a rear substrate of a field emission display according to a third embodiment of the present invention. In the third embodiment of the present invention, first emitters 12A and second emitters 12B are alternately arranged on the first sub-electrodes 16 and the second sub-electrodes 18, respectively, of first cathode electrodes 10A. Also, the first emitters 12A and the second emitters 12B are alternately arranged respectively on the second sub-electrodes 18 and the first sub-electrodes 16 of second cathode electrodes 10B, which are adjacent to the first cathode electrodes 10A. That is, in the third embodiment of the present invention, the field emitters 12 of the first and second cathode electrodes 10A and 10B are provided in opposite arrangements, with the first emitters 12A being provided on the first sub-electrodes 16 of the first cathode electrodes 10A and on the second sub-electrodes 18 of the second cathode electrodes 10B, and the second emitters 12B being provided on the second sub-electrodes 18 of the first cathode electrodes 10A and on the first sub-electrodes 16 of the second cathode electrodes 10B. As a result of the arrangement shown in FIG. 6, the second emitters 12B provided on adjacent first and second cathode electrodes 10A and 10B are arranged in close proximity to one another, while the first emitters 12A provided on adjacent first and second cathode electrodes 10A and 10B are arranged at a greater distance from one another than a distance between the first emitters 12A.

In the first and second embodiments of the present invention, at areas where dispersion of the electron beams is the greatest (an example is shown by an ellipse 27 in FIG. 2), the electron beams intersect such that there is a possibility that the electron beams land on phosphor layers of adjacent pixels (i.e., of different colors). With the arrangement of the field emitters 12 as in the third embodiment of the present invention and considering that the phosphor layers are arranged in rows along the lines of the gate electrodes 6, phosphor layers of the same color are positioned at areas where the dispersion of electron beams is the greatest (an example is shown by the ellipse 29 in FIG. 6) such that the landing of electron beams on unintended phosphor layers is even more effectively prevented.

Figure 7:
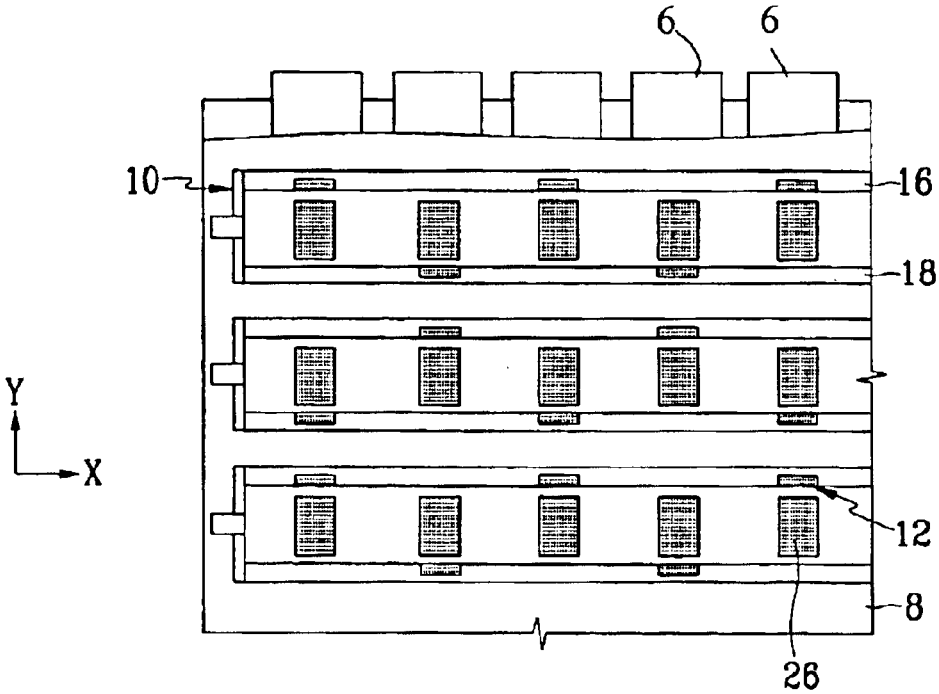
FIG. 7 is a partial plan view of a rear substrate of a field emission display according to a fourth embodiment of the present invention.

Referring now to FIG. 7, a fourth embodiment of the present invention differs from the configuration of the third embodiment of the present invention in an arrangement of the field emitters 12 relative to the counter electrodes 26, which are formed between first and second sub-electrodes 16 and 18 of cathode electrodes 10. As in the third embodiment, the counter electrodes 26 enable the FED to be driven at a low voltage.

In the present invention, the arrangement of the field emitters 12 is arranged to prevent mis-landing of the electron beams. It is preferable that phosphor layers 22 and spacers 24 are formed to correspond with the arrangement of the field emitters 12.

Figure 8:
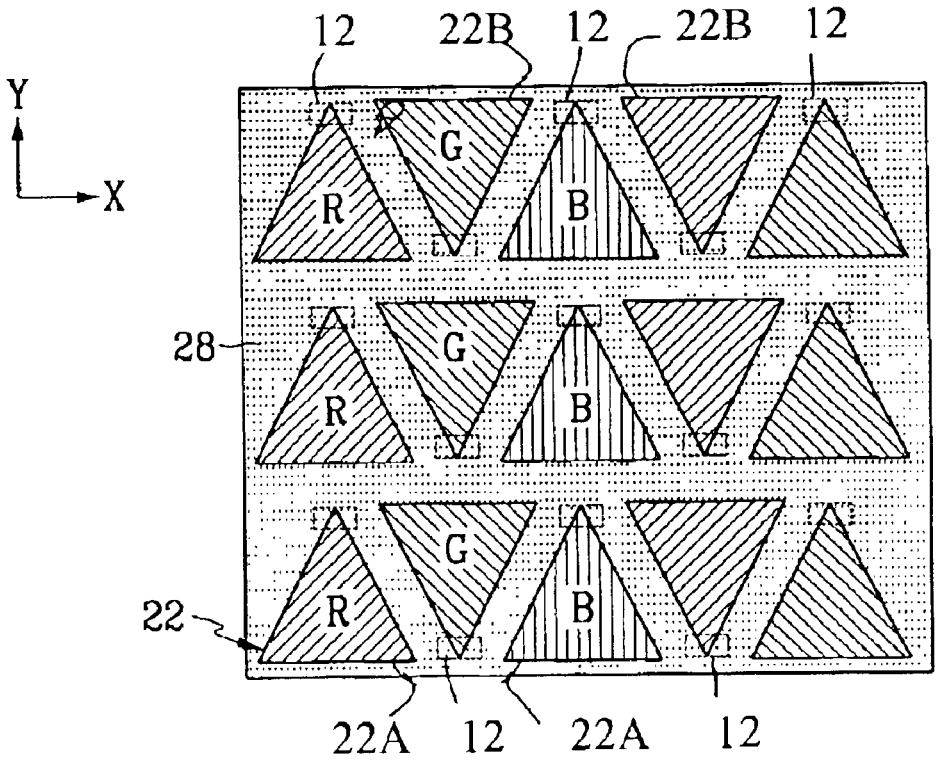
FIG. 8 is a schematic view of a phosphor layer pattern that may be applied to the first and second embodiments of the present invention.
Figure 9A:
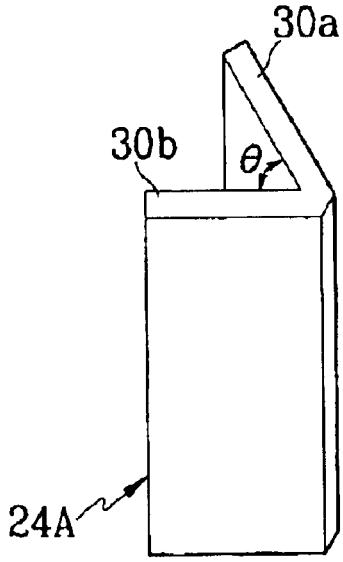
FIG. 9A is a schematic view of a spacer that may be applied to the first and second embodiments of the present invention.
Figure 9B:
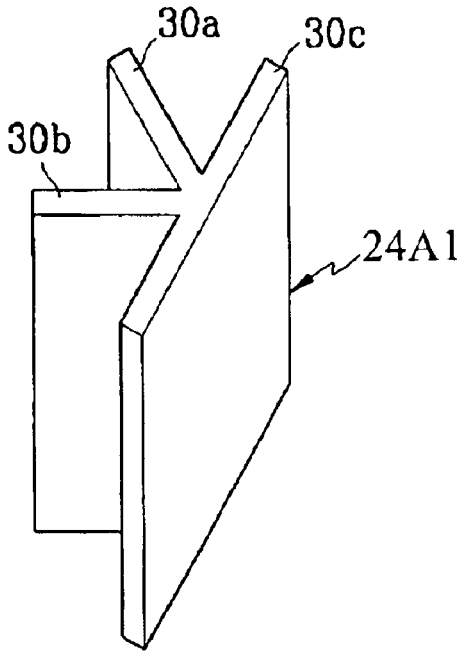
FIG. 9B is a schematic view of another spacer that may be applied to the first and second embodiments of the present invention.

FIG. 8 is a schematic view of a phosphor layer pattern that may be applied to the first and second embodiments of the present invention, and FIGS. 9A and 9B are schematic views of spacers (herinafter referred to as "first spacers") that may be applied to the first and second embodiments of the present invention. Referring now to FIG. 8, the R (red), G (green), and B (blue) phosphor layers 22 are formed in substantially triangular shapes, each triangular shape having an apex corresponding to the location of a respective one of the emitters 12 and sides that expand from the apex following the dispersion paths of the electron beams. In FIG. 8, an emitter 12 is schematically shown superimposed at the apex of each triangular phosphor shape.

As an example, in the case where the R, G, and B phosphor layers 22 are continuously arranged along the axis X direction. The phosphor layers 22 comprise first phosphor layers 22A which are formed with their respective apexes pointed in one direction and second phosphor layers 22B which are formed with their respective apexes pointed in an opposite direction with respect to the axis Y direction. Therefore, in the axis Y direction, all the phosphor layers 22 are arranged with their apexes pointed in either a same direction or an opposite direction. Further, a black matrix 28 is formed between the phosphor layers 22 to improve a contrast ratio of the screen.

To correspond with the formation of the phosphor layers 22 as shown in FIG. 8, first spacers 24A are formed of first and second supports 30*a* and 30*b* as shown in FIG. 9A. The first and second supports 30*a* and 30*b* are plates connected along one side and provided at a predetermined angle (θ) at the points of connection between the plates. Therefore, where the first spacers 24A are mounted in the FED in a state where their points of connection correspond to the apexes of the phosphor layers 22, the first and second supports 30*a* and 30*b* surround the sides of the phosphor layers 22 extending from the apexes. As an example, the angle (θ) at the point of connection is 60°.

Alternatively, as shown in FIG. 9B, first spacers 24A1 may be provided. Each first spacers 24A may include a third support 30*c* that is formed in the Y axis direction following the gate electrode line when mounted in the FED. The third support 30*c* is integrally formed to the first spacers 24A1 at points of connection of first and second supports 30*a* and 30*b*.

Figure 10:
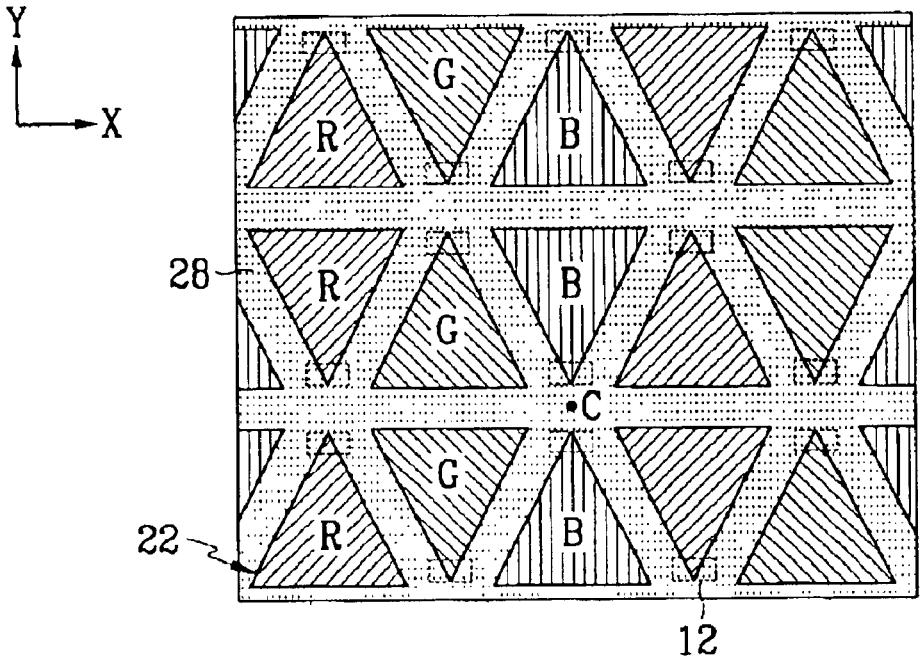
FIG. 10 is a schematic view of a phosphor layer pattern that may be applied to the third and fourth embodiments of the present invention.
Figure 11A:
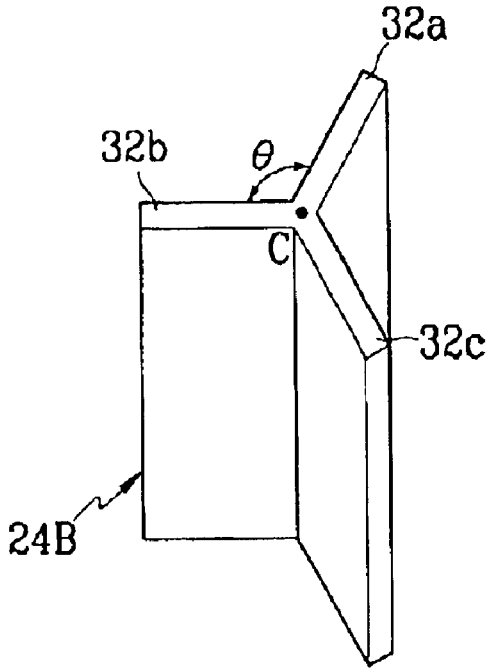
FIG. 11A is a schematic view of a spacer that may be applied to the third and fourth embodiments of the present invention.
Figure 11B:
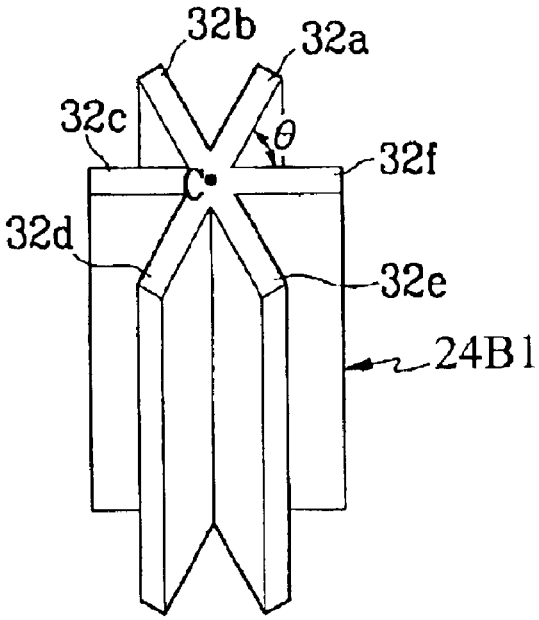
FIG. 11B is a schematic view of another spacer that may be applied to the third and fourth embodiments of the present invention.

FIG. 10 is a schematic view of a phosphor layer pattern that may be applied to the third and fourth embodiments of the present invention, and FIGS. 11A and 11B are schematic views of spacers (hereinafter referred to as "second spacers") that may be applied to the third and fourth embodiments of the present invention. As shown in FIG. 10, the R, G, and B phosphor layers 22 are formed in substantially triangular shapes, each having an apex corresponding to a location of a respective one of the field emitters 12 and sides that expand from the respective apexs of the triangular shape following the dispersion paths of the respective electron beams. Therefore, in the axis X direction, the apexes of the phosphor layers 22 repeatedly alternate the direction that they point with respect to the axis Y direction. With the configuration shown in FIG. 10, the phosphor layers 22 are rotationally symmetrical about predetermined points, for example, at point C in FIG. 10. Second spacers 24B are also formed rotationally symmetrical to thereby increase their supporting strength.

As an example, in the case where the phosphor layers 22 are formed as equilateral triangles, the second spacers 24B may be formed including first, second, and third supports 32*a*, 32*b*, and 32*c*, which are interconnected along points of connection along one side of each support as shown in FIG. 11A. Where placed in the FED, a line passing through the points of connection of the first, second, and third supports 32*a*, 32*b*, and 32*c* intersects point C such that the second spacers 24B may be provided where the points of six of the triangular shapes of the phosphor layers 22 merge.

Further, the first, second, and third supports 32*a*, 32*b*, and 32*c* are provided at a predetermined angle θ1 of approximately 120° at the points of connection. Alternatively, second spacers 24B1 may include six supports 32*a*, 32*b*, 32*c*, 32*d*, 33*e* and 33*f* that are provided at a predetermined angle (θ2) of approximately 60° at points of connection.

In the FED of the present invention described above, alternative to the structure in which the first and second sub-electrodes 16 and 18 of the cathode electrodes 10 are separated and the emitters 12 are formed on edges of the first and second sub-electrodes 16 and 18, a structure may be used in which holes are formed in the cathode electrodes 10 and the field emitters 12 are arranged at edges of the holes on the cathode electrodes 10.

Figure 12:
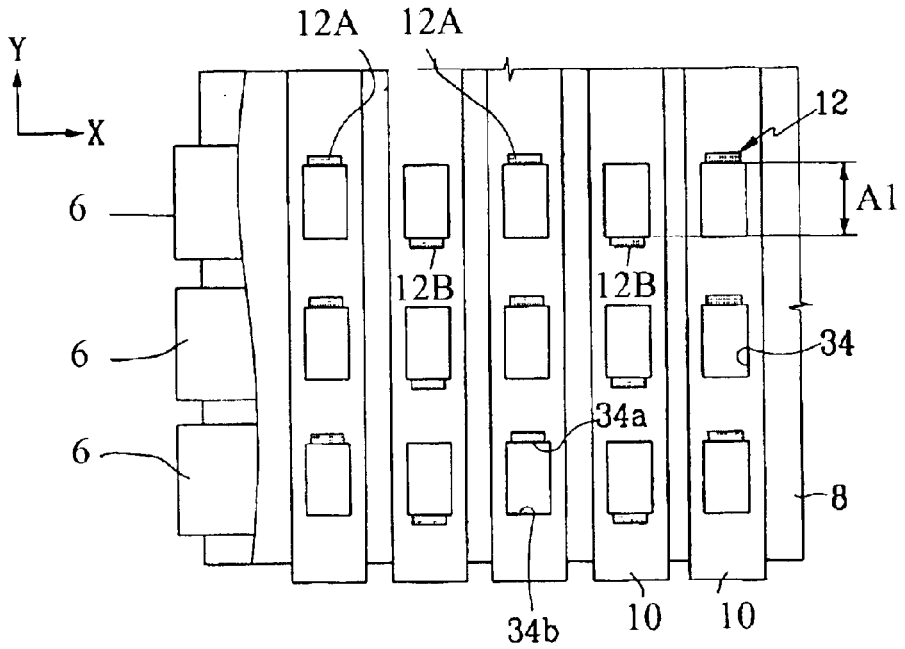
FIG. 12 is a partial plan view of a rear substrate of a field emission display according to a fifth embodiment of the present invention.

FIG. 12 is a partial plan view of a rear substrate of a field emission display according to a fifth embodiment of the present invention. In the fifth embodiment, gate electrodes 6 are formed in a line pattern along an axis X direction, and cathode electrodes 10 are formed in a line pattern along an axis Y direction such that the cathode electrodes 10 are perpendicular to the gate electrodes 6. An insulating layer 8 is interposed between the cathode electrodes 10 and the gate electrodes 6.

Further, in each pixel region, holes 34 that pass through the cathode electrodes 10 and expose the insulation layer 8 are formed in the cathode electrodes 10. A field emitter 12 is formed along an edge of each of the holes 34 and on the cathode electrodes 10. The field emitters 12 are positioned such that there is a predetermined distance A1 in an axis Y direction between the field emitters 12 of adjacent cathode electrodes 10 as shown in FIG. 12.

In more detail, the holes 34 are substantially rectangular including short sides, that is, first and second sides 34*a* and 34*b* that are formed along the axis X direction at opposite ends of the holes 34. First emitters 12A are formed on the cathode electrodes 10 at edges of the first sides 34*a* of select holes 34 and second emitters 12B are formed on the cathode electrodes 10 at edges of the second sides 34*a* of select holes 34. That is, since only one of the field emitters 12 is provided at each of the holes 34, the first emitters 12A are formed at edges of the first sides 34*a* of all the holes 34 in one cathode electrode 10, and the second emitters 12B are formed at edges of the second sides 34*b* of all the holes 34 of an adjacent cathode electrode 10. This alternating formation of the field emitters 12 is repeated for all the cathode electrodes 10 such that the field emitters 12 form a zigzag pattern along the axis X direction.

The holes 34 enable electric fields to be more easily formed in the peripheries of the field emitters 12 through the exposed insulating layers 8 by a difference in voltages between the gate electrodes 6 and the cathode electrodes 10 such that a drive voltage may be reduced. Therefore, if a predetermined DC or AC voltage is applied between the gate electrodes 6 and the cathode electrodes 10, electric fields are formed in the peripheries of the field emitters 12 through the exposed insulating layer 8 such that electrons are emitted from the field emitters 12.

In the fifth embodiment of the present invention as described above, the field emitters 12 are structured such that first emitters 12A and second emitters 12B are formed on the cathode electrodes 10 along the first sides 34*a* and the second sides 34*b*, respectively. As a result, on areas of the cathode electrodes 10 corresponding to each of the gate electrodes 6, the field emitters 12 are identically arranged.

Figure 13:
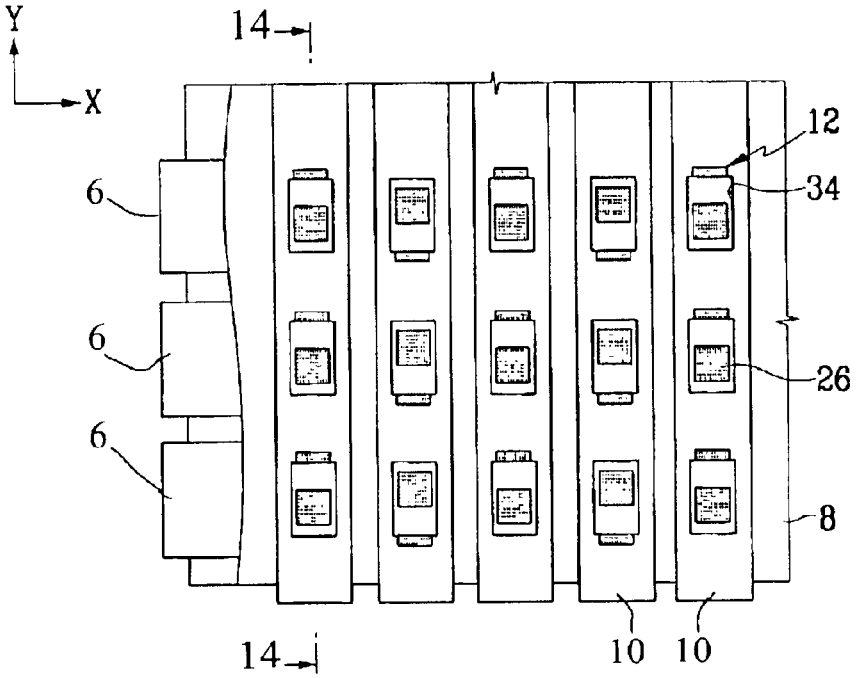
FIG. 13 is a partial plan view of a rear substrate of a field emission display according to a sixth embodiment of the present invention.
Figure 14:
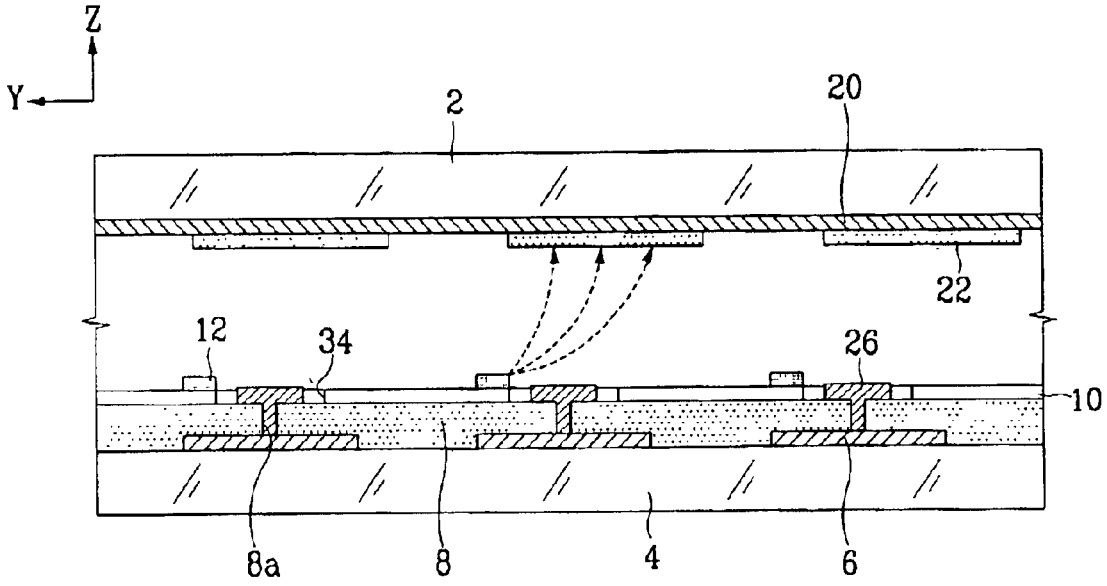
FIG. 14 is sectional view of the rear substrate shown in FIG. 13 taken along line 14—14 of FIG. 13 and shown opposite a corresponding section of the front substrate shown in FIG. 1.

Referring now to FIGS. 13 and 14, an FED according to a sixth embodiment of the present invention further comprises passageways 8*a*, which are formed within holes 34 and passing through the insulating layer 8. Counter electrodes 26 made of a conductive material are formed within the holes 34 and within the passageways 8*a* to be electrically connected to the gate electrodes 6.

The counter electrodes 26 perform the same function as described with reference to the previously described embodiments. Also, a pattern of phosphor layers 22 and a pattern of spacers (not shown) suitable for the fifth and sixth embodiments of the present invention are identical to those described with reference to the first and second embodiments of the present invention and shown in FIGS. 8, 9A, and 9B.

Figure 15:
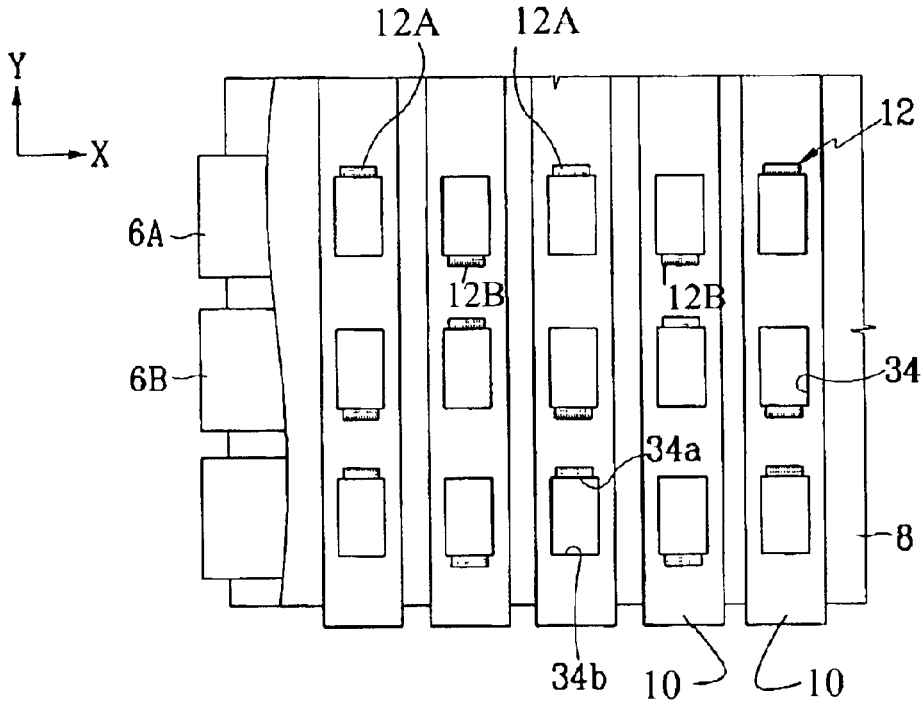
FIG. 15 is a partial plan view of a rear substrate of a field emission display according to a seventh embodiment of the present invention.

Referring now to FIG. 15, in an FED according to a seventh embodiment of the present invention, first emitters 12A and second emitters 12B are formed on cathode electrodes 10 along first sides 34*a* and second sides 34*b*, respectively, of holes 34 in areas of the cathode electrodes 10 corresponding to first gate electrodes 6A. Further, the first emitters 12A and the second emitters 12B are formed on the cathode electrodes 10 along the second sides 34*b* and the first sides 34*a*, respectively, of the holes 34 in areas of the cathode electrodes 10 corresponding to second gate electrodes 6B, which are adjacent to the first gate electrodes 6A. Therefore, instead of the field emitters 12 being identically arranged on areas of the cathode electrodes 10 corresponding to each of the gate electrodes 6, the field emitters 12 are arranged on areas of the cathode electrodes 10 corresponding to the first gate electrodes 6A opposite to the way the field emitters 12 are arranged on areas of the cathode electrodes 10 corresponding to the second gate electrodes 6B.

In the seventh embodiment of the present invention, with the arrangement of the field emitters 12 as described above and considering that phosphor layers (not shown) of the same color are arranged in rows along gate electrode lines, phosphor layers of the same color are positioned at areas where the dispersion of electron beams is the greatest such that the landing of electron beams on unintended phosphor layers is prevented. This prevents a reduction in color purity by the landing of electron beams on phosphor layers of the wrong color.

Figure 16:
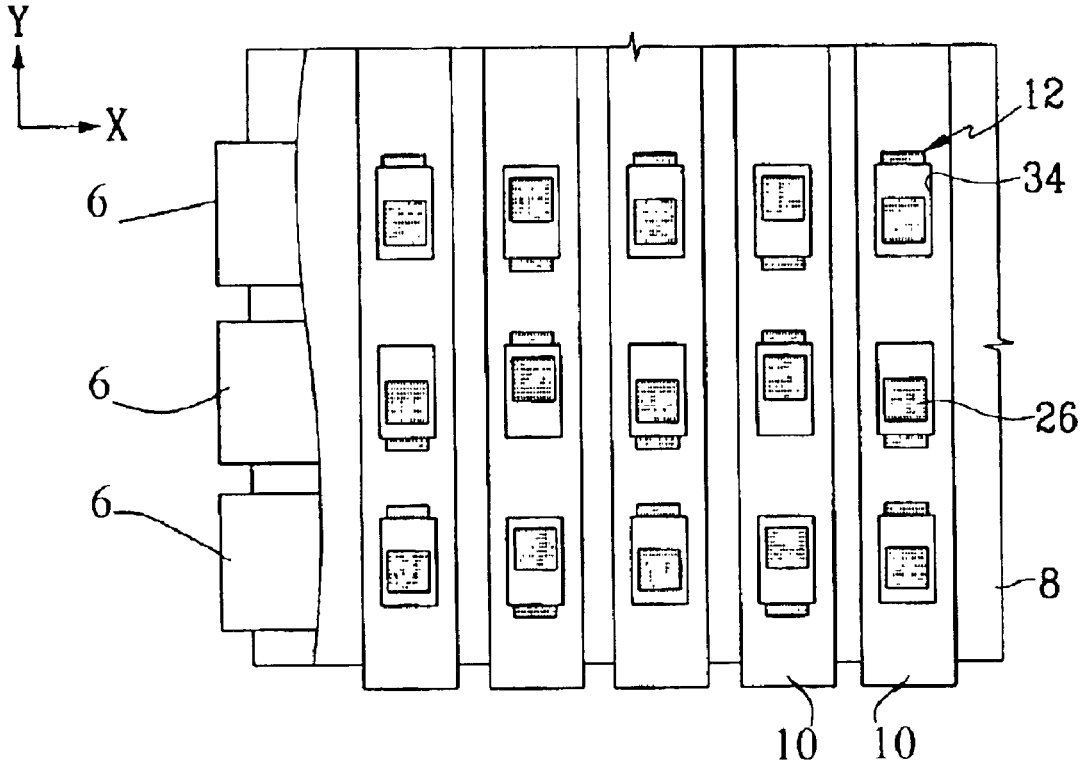
FIG. 16 is a partial plan view of a rear substrate of a field emission display according to an eighth embodiment of the present invention.

Referring now to FIG. 16, an FED according to an eighth embodiment of the present invention, is constructed as in the seventh embodiment except that the eighth embodiment further comprises counter electrodes 26 formed in holes 34 of the cathode electrodes 10.

A pattern of phosphor layers (not shown) and a pattern of spacers (not shown) suitable for the seventh and eighth embodiments of the present invention are identical to those described with reference to the third and fourth embodiments of the present invention and shown in FIGS. 10, 11A, and 11B.

In the FED of the present invention described above, the landing of electron beams on phosphor layers of the wrong color by the dispersion of electron beams is prevented by varying the arrangement of the emitters and without the addition of separate electrodes for electron beam focusing, thereby enhancing color purity. Further, a filling ratio of electron beams with respect to corresponding phosphor layers is increased to improve picture brightness.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A field emission display, comprising:

a front substrate and a rear substrate provided opposite one another with a predetermined gap therebetween;

gate electrodes formed in a line pattern in a first direction and cathode electrodes formed in a line pattern in a second direction on a surface of the rear substrate opposing the front substrate, with a pixel region being defined at an intersection of one of the gate electrodes and one of the cathode electrodes:

an insulating layer formed between the gate electrodes and the cathode electrodes to insulate the gate electrodes from the cathode electrodes;

field emitters formed on the cathode electrodes at areas corresponding to each pixel region;

an anode electrode formed over an entire surface of the front surface; and phosphor layers formed on the anode electrode to be exposed to the predetermined gap, each of the phosphor layers being disposed at one of the pixel regions;

wherein, for each one of the cathode electrodes, ones of the field emitters are disposed along one side of the one cathode electrode in the second direction and are separated by corresponding intersections of the one side and corresponding ones of the gate electrodes at which no field emitter is disposed, and others of the field emitters are disposed along another side of the one cathode electrode in the second direction and are separated by corresponding intersections of the another side and corresponding other ones of the gate electrodes at which no field emitter is disposed such that the ones of the field emitters form a zigzag pattern with the others of the field emitters on the one cathode electrode.

2. The field emission display of claim 1, wherein each of the field emitters comprises a carbon-based material selected as one or more from the group consisting of carbon nanotubes, graphite, diamond-like carbon, and C60 (Fullerene).

3. The field emission display of claim 1, wherein:

the field emitters include first emitters on a first cathode electrode and second emitters disposed on a second cathode electrode, and adjacent pairs of the first and second emitters are disposed on the first and second cathode electrodes so as face each other on adjacent gate electrodes to form in the zigzag pattern.

4. The field emission display of claim 3, wherein:

each of the cathode electrodes comprise first and second sub-electrodes arranged in a line pattern at a predetermined distance apart, and a connecting electrode that electrically connects the first and second sub-electrodes.

5. The field emission display of claim 4, wherein for each cathode electrode, the first emitters are arranged on a first long edge of the first sub-electrode so as to be opposite a second long edge of the second sub-electrode, and the second emitters are arranged on the second long edge of the second sub-electrode so as to be opposite the first long edge of the first sub-electrode.

6. The field emission display of claim 5, wherein the insulating layer further comprises holes passing through the insulating layer at corresponding pixel regions between the first and second sub-electrodes, and the field emission display further comprises counter electrodes, each counter electrode being within the one of the holes to be electrically connected to one of the gate electrodes.

7. The field emission display of claim 4, wherein:

the zigzag pattern comprises first and second zigzag patterns, first ones of the cathode electrodes are adjacent second ones of the cathode electrodes, the first and second emitters are arranged respectively on ones of the first and second sub-electrodes of the first cathode electrodes to form the first zigzag patterns, and the first and second emitters are arranged respectively on others of the first and second sub-electrodes of the second cathode electrodes to form the second zigzag patterns which are different from the first zigzag patterns.

8. The field emission display of claim 7, wherein the insulating layer further comprises holes passing through the insulating layer in pixel regions between the first and second sub-electrodes, and the field emission display further comprises counter electrodes, each counter electrode being within one of the holes to be electrically connected to one of the gate electrodes.

9. The field emission display of claim 1, wherein the field emitters include first emitters and second emitters, which are alternately arranged in the first direction of gate electrodes, the first emitters having a predetermined distance in a direction perpendicular to the first direction from the adjacent second emitters to thereby result in the zigzag pattern with the first and second emitters.

10. The field emission display of claim 9, wherein the insulating layers comprise holes in the cathode electrodes to expose the insulating layer at areas corresponding to each pixel region, and the field emitters are formed on the cathode electrodes at an edge of each of the holes.

11. The field emission display of claim 10, wherein each of the holes includes first and second sides parallel to the first direction, and the first emitters are formed on the cathode electrodes along the first sides of the holes and the second emitters are formed on the cathode electrodes along the second sides of the holes.

12. The field emission display of claim 11, further comprising passageways formed within the holes and passing through the insulating layer, and the field emission display further comprises counter electrodes formed within the holes and within the passageways to be electrically connected to the gate electrodes.

13. The field emission display of claim 10, wherein:

the holes include first and second sides that are parallel to the first direction, along an area corresponding to any one of the gate electrodes, the first and second emitters are formed on the cathode electrodes respectively at edges of one of the first and second sides of the holes, and along an adjacent one of the gate electrodes, the first and second emitters are formed on the cathode electrodes respectively at edges of the other of the first and second sides of the holes.

14. The field emission display of claim 13, further comprising passageways, which are formed within the holes and passing through the insulating layer, and counter electrodes formed within the holes and within the passageways to be electrically connected to the gate electrodes.

15. The field emission display of claim 1, wherein the phosphor layers include R (red), G (green), and B (blue) phosphor layers corresponding to each of the field emitters, wherein each of the R, G, and B phosphor layers is substantially triangular in shape in which each triangle shape includes an apex corresponding to positions of the field emitters and sides extending from the apex.

16. The field emission display of claim 15, wherein, along one of the first and second directions, apexes of the phosphor layers point in one direction to form a designated line passing through these apexes, and along a line adjacent and parallel to the designated line, apexes of the phosphor layers point in the opposite direction, this pattern repeating for all the phosphor layers.

17. The field emission display of claim 15, wherein, along each of the first and second directions, apexes of the phosphor layers point alternately in opposite directions.

18. The field emission display of claim 15, further comprising spacers provided between the front and rear substrates, the spacers including first and second supports surrounding without covering two sides of each of the phosphor layers.

19. The field emission display of claim 18, wherein the spacers include also a third side connected to the first and second sides and formed along the first direction to be parallel to a side of an adjacent phosphor layer.

20. The field emission display of claim 15, further comprising spacers provided between the front and rear substrates, the spacers including three supports that are rotationally symmetrical about a center point where corners of six phosphor layers merge.

21. The field emission display of claim 20, wherein the spacers include six supports that are rotationally symmetrical about the center point.

22. A field emission display, comprising:

a front substrate and a rear substrate disposed opposite one another with a predetermined gap therebetween;

gate electrodes formed in a line pattern in a first direction on a surface of the rear substrate opposite the front substrate;

an insulating layer formed over an entire surface of the rear substrate and covering the gate electrodes;

cathode electrodes, each of the cathode electrodes including first and second sub-electrodes arranged in a line pattern in a second direction perpendicular to the first direction, the first and second sub-electrodes being separated at a predetermined distance and being electrically connected by a connecting electrode, each intersection of one of the cathode electrodes and one of the gate electrodes defining a pixel region;

field emitters formed on the cathode electrodes at areas corresponding to each pixel region, the field emitters including first emitters and second emitters, the first emitters and the second emitters being alternately arranged in the second direction;

an anode electrode formed over an entire surface of the front surface opposite the rear substrate; and phosphor layers formed on the anode electrode, wherein, for each cathode electrode, the first emitters are arranged on a first long edge of the first sub-electrode so as to be opposite the second sub-electrode, and the second emitters are arranged on a second long edge of the second sub-electrode so as to be opposite the first sub-electrode.

23. The field emission display of claim 22, wherein the insulating layer further comprises holes passing through the insulating layer in pixel regions between the first and second sub-electrodes, and the field emission display further comprises counter electrodes, each counter electrode being formed within one of the holes to be electrically connected to one of the gate electrodes.

24. The field emission display of claim 22, wherein:

first ones of the cathode electrodes are adjacent to second ones of the second cathode electrodes, the first and second emitters are arranged respectively on ones of the first and second sub-electrodes of the first cathode electrodes, and the first and second emitters are arranged respectively on other ones of the first and second sub-electrodes of the second cathode electrodes.

25. The field emission display of claim 24, wherein the insulating layer further comprises holes passing through the insulating layer in pixel regions between the first and second sub-electrodes, and the field emission display further comprises counter electrodes, each counter electrode being formed within the holes to be electrically connected to the gate electrodes.

26. The field emission display of claim 22, wherein the phosphor layers include R (red), G (green), and B (blue) phosphor layers corresponding to each of the field emitters, wherein each of the R, G, and B phosphor layers is substantially triangular in shape in which each triangle shape includes an apex corresponding to positions of one of the field emitters and sides extending from the apex.

27. The field emission display of claim 26, wherein, along the second direction, the apexes of the phosphor layers point in opposite directions.

28. The field emission display of claim 26, further comprising spacers provided between the front and rear substrates, the spacers including first and second supports surrounding without covering two sides of the phosphor layers.

29. The field emission display of claim 28, wherein the spacers include also a third side connected to the first and second sides and formed along the first direction to be parallel to a side of an adjacent phosphor layer.

30. A field emission display, comprising:

a front substrate and a rear substrate disposed opposite one another with a predetermined gap therebetween;

gate electrodes formed in a line pattern in a first direction on a surface of the rear substrate opposite the front substrate;

an insulating layer formed over an entire surface of the rear substrate and covering the gate electrodes;

cathode electrodes arranged in a line pattern in a second direction perpendicular to the first direction, each of the cathode electrode comprising holes that expose the insulating layer at pixel regions, each pixel region defined at an intersection of one of the gate electrodes and one of the cathode electrodes;

field emitters formed on the cathode electrodes at areas corresponding to each pixel region, the field emitters including first emitters and second emitters alternately arranged in the first direction;

an anode electrode formed over an entire surface of the front surface opposite to the rear substrate; and phosphor layers formed on the anode electrode, wherein:

the holes include first and second sides that are parallel to the gate electrodes, the first emitters are formed on the cathode electrodes along the first sides of the holes, and the second emitters are formed on the cathode electrodes along the second sides of the holes.

31. The field emission display of claim 30, further comprising passageways, which are formed within the holes and passing through the insulating layer, and the field emission display further comprises counter electrodes formed within the holes and within the passageways to be electrically connected to the gate electrodes.

32. The field emission display of claim 30, wherein along an area corresponding to one of the gate electrodes, the first and second emitters are formed on the cathode electrodes respectively at ones of the first and second sides of the holes, and along an adjacent one of the gate electrodes, the first and second emitters are formed on the cathode electrodes respectively at others of the second and first sides of the holes.

33. The field emission display of claim 32, further comprising passageways, which are formed within the holes and passing through the insulating layer, and the field emission display further comprises counter electrodes formed within the holes and within the passageways to be electrically connected to the gate electrodes.

34. The field emission display of claim 30, wherein the phosphor layers include R (red), G (green), and B (blue) phosphor layers corresponding to each of the field emitters, wherein each of the R, G, and B phosphor layers are substantially triangular in shape in which each triangle shape includes an apex corresponding to positions of the field emitters and sides extending from the apex.

35. The field emission display of claim 34, wherein:

along one of the first and second directions, apexes of the phosphor layers point in the one direction to form a designated line passing through these apexes, and along a line adjacent and parallel to the designated line, apexes of the phosphor layers point in the opposite direction, this pattern repeating for all the phosphor layers.

36. The field emission display of claim 34, further comprising spacers provided between the front and rear substrates, the spacers including three supports that are rotationally symmetrical about a center point where corners of six phosphor layers merge.

37. The field emission display of claim 36, wherein the spacers include six supports that are rotationally symmetrical about the center point.

38. A field emission display, comprising:

first and second substrates having first and second opposing surfaces, respectively, which are separated by a gap;

an anode electrode formed on the first opposing surface; phosphor layers formed on the anode electrode and divided into pixel regions which are arranged in first and second directions;

a plurality of adjacently arranged gate electrodes formed on the second opposing surface and running in one of the first and second directions;

a plurality of adjacently arranged cathode electrodes formed over the gate electrodes and running transverse to the gate electrodes;

an insulating layer which insulates the cathode electrodes and the gate electrodes; and a plurality of field emitters formed on the cathode electrodes, wherein:

one of the plurality of field emitters is formed at each area where one of the plurality of cathode electrodes crosses one of the plurality of gate electrodes, the field emitters are arranged in rows running in the first direction, and the field emitters of pairs of adjacent rows form zigzag patterns.

39. The field emission display of claim 38, wherein adjacent zigzag patterns have a same pattern orientation.

40. The field emission display of claim 39, further comprising:

a plurality of counter electrodes; and wherein:

each cathode has a window through which the gate electrodes are accessible, a group of the plurality of counter electrodes is formed in each window, each of the plurality of counter electrodes is formed adjacent a respective one of the plurality of field emitters, and each of the plurality of counter electrodes is formed to contact a selected one of the plurulity of gate electrodes.

41. The field emission display of claim 39, further comprising:

a plurality of counter electrodes; and wherein:

each cathode has a plurality of windows, one of the plurality of gate electrodes is accessible through each window, each of the plurality of field emitters is formed adjacent a respective one of the plurality of windows;

one of the plurality of counter electrodes is formed in each of the plurality of windows, and each of the plurality of counter electrodes is formed to contact a selected one of the plurality of gate electrodes.

42. The field emission display of claim 39, wherein the field emitters are formed of one or more carbon-based materials selected from the group consisting of carbon nanotubes, graphite, diamond-like carbon, and C60 (Fullerene).

43. The field emission display of claim 38, wherein adjacent zigzag patterns have an opposite pattern orientation.

44. The field emission display of claim 43, further comprising:

a plurality of counter electrodes; and wherein:

each cathode has a window through which the gate electrodes are accessible, a group of the plurality of counter electrodes is formed in each window, each of the plurality of counter electrodes is formed adjacent a respective one of the plurality of field emitters, and each of the plurality of counter electrodes is formed to contact a selected one of the plurality of gate electrodes.

45. The field emission display of claim 43, further comprising:

a plurality of counter electrodes; and wherein:

each cathode has a plurality of windows, one of the plurality of gate electrodes is accessible through each window, each of the plurality of field emitters is formed adjacent a respective one of the plurality of windows;

one of the plurality of counter electrodes is formed in each of the plurality of windows, and each of the plurality of counter electrodes is formed to contact a selected one of the plurality of gate electrodes.

46. The field emission display of claim 43, wherein the field emitters are formed of one or more carbon-based materials selected from the group consisting of carbon nanotubes, graphite, diamond-like carbon, and C60 (Fullerene).

47. The field emission display of claim 38, wherein the field emitters are formed of one or more carbon-based materials selected from the group consisting of carbon nanotubes, graphite, diamond-like carbon, and C60 (Fullerene).

48. The field emission display of claim 38, wherein:

each pixel region has a triangle shape having a base and an apex;

each pixel region is positioned across the gap from a corresponding one of the field emitters; and each field emitter is positioned nearer to the apex of the corresponding pixel than to the base of the corresponding pixel.

49. The field emission display of claim 48, wherein:

the first and second directions correspond to rows and columns of an array, the apexes of adjacent pixel regions in each row of the array alternate directions, and the apexes of adjacent pixel regions in each column of the array have a same direction.

50. The field emission display of claim 49, further comprising a spacer system which isolates each of the plurality of pixel regions from the field emitters corresponding to adjacent pixel regions, the spacer system being formed in the gap.

51. The field emission display of claim 50, wherein:

the first and second directions correspond to rows and columns of an array, the apexes of adjacent pixel regions in each row of the array alternate directions, and the apexes of adjacent pixel regions in each column of the array alternate directions.

52. The field emission display of claim 48, wherein:

the first and second directions correspond to rows and columns of an array, the apexes of adjacent pixel regions in each row of the array alternate directions, and the apexes of adjacent pixel regions in each column of the array alternate directions.

* * * * *